United States Patent [19]

Foster et al.

[11] Patent Number: 4,635,803

[45] Date of Patent: Jan. 13, 1987

[54] COMPACT PEDESTAL-MOUNT CRANE

[75] Inventors: Frank S. Foster; Gerald P. Berger, both of Cedar Rapids, Iowa

[73] Assignee: FMC Corporation, Chicago, Ill.

[21] Appl. No.: 763,312

[22] Filed: Aug. 6, 1985

Related U.S. Application Data

[63] Continuation of Ser. No. 508,973, Jun. 29, 1983, abandoned.

[51] Int. Cl.[4] ..... B66C 23/52

[52] U.S. Cl. ..... 212/192; 212/239; 212/262

[58] Field of Search ..... 212/190, 192, 206, 211, 212/223, 227, 230–232, 237, 239, 262; 114/264–265

[56] References Cited

U.S. PATENT DOCUMENTS

| | | | |
|---|---|---|---|
| 1,825,359 | 9/1931 | Manley | 212/262 |
| 2,051,388 | 8/1936 | Nickles | 212/239 |
| 2,529,200 | 11/1950 | Swanson | 212/239 |
| 2,999,600 | 9/1961 | Gates | 212/231 |
| 3,923,163 | 12/1975 | Brewer | 212/239 |
| 4,061,230 | 12/1977 | Goss et al. | 212/253 |
| 4,183,440 | 1/1980 | Wilkinson | 212/231 |
| 4,184,600 | 1/1980 | Goss et al. | 212/253 |
| 4,216,870 | 8/1980 | Bonneson et al. | 212/223 |
| 4,271,970 | 6/1981 | Miller et al. | 212/146 |

FOREIGN PATENT DOCUMENTS

| | | | |
|---|---|---|---|
| 900266 | 12/1953 | Fed. Rep. of Germany | 212/262 |
| 1176812 | 8/1964 | Fed. Rep. of Germany | 212/195 |
| 1285151 | 12/1968 | Fed. Rep. of Germany | 212/239 |
| 2340171 | 2/1975 | Fed. Rep. of Germany | 212/223 |
| 570086 | 12/1957 | Italy | 212/244 |
| 15291 | of 1894 | United Kingdom | 212/239 |
| 19585 | of 1907 | United Kingdom | 212/239 |
| 324055 | 1/1930 | United Kingdom | 212/262 |

*Primary Examiner*—Sherman D. Basinger
*Assistant Examiner*—Stephen P. Avila
*Attorney, Agent, or Firm*—Ronald C. Kamp; Richard B. Megley

[57] ABSTRACT

A compact pedestal crane having a boom pivoted at a front edge of a main frame with a winch frame aligned with the boom and a plurality of winches mounted on the winch frame. An A-frame gantry is mounted on and extends above the winch frame and an engine drawingly connected to a plurality of hydraulic pump is mounted on the frame underneath the winch frame to conserve space. A cab is supported from the main frame to one side of the boom and forward of the front edge.

4 Claims, 3 Drawing Figures

COMPACT PEDESTAL-MOUNT CRANE

This application is a continuation of application Ser. No. 508,973, filed June 29, 1983, now abandoned.

This invention relates to pedestal-mount cranes, and more particularly to such cranes commonly referred to as hydraulic offshore cranes.

The present invention physically arranges the necessary components of a hydraulic pedestal-mount crane so that the crane is compact, serving the need to conserve space which is at a premium on an offshore platform, so that the various crane components may be easily maintained and repaired or replaced, and so that the operation of the crane is safe and efficient.

The drawings are briefly described as follows.

Figure 1:
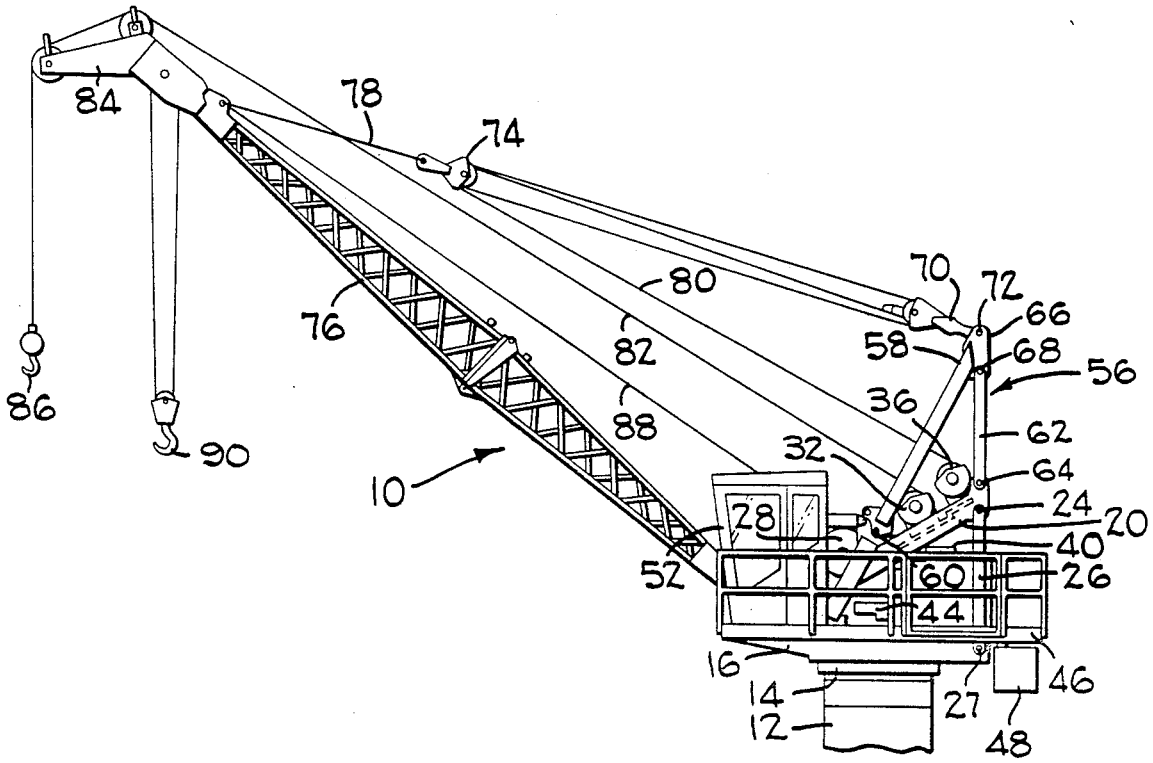
FIG. 1 is a side elevational view of the crane according to the present invention.

A preferred embodiment of the present invention is shown in the drawings, wherein a crane upper, indicated generally at 10, is swingably mounted, i.e., rotatable about vertical axis 11, on a pedestal 12 supported on the deck of an offshore platform by a turntable 14. The turntable 14 is secured to and supports a main frame 16, which has a front edge 18. A winch frame 20 is positioned to extend perpendicular to the front edge 18, is laterally centered over the axis 11, and extends substantially the length of the frame 16. The winch frame 20 is pinned at 22 to the frame 16 at its front end adjacent to the front edge 18 and is pinned at 24 to a pair of vertical links 26, which links are pinned at 27 to the frame 16. Main winch 28 driven by a hydraulic motor 30 is mounted on the winch frame 20. An auxiliary winch 32 driven by hydraulic motor 34 and a boom hoist winch 36 driven by hydraulic motor 38 are also mounted on the winch frame 20. An engine 40 is mounted on the frame 16 beneath the winch frame 20 with its fore and aft axis, i.e., the center line of its crankshaft, oriented perpendicular to the front edge 18 and passing through the axis 11. The engine's radiator 42 is positioned substantially between the links 26 and a pump 44 with multiple pump sections is attached to and driven by the engine, the pumps being located on the engine opposite the radiator.

A catwalk 46, which is substantially U-shaped in plan form, encircles three sides of, and is cantilevered from, the frame 16. A fuel tank 48 is suspended below the catwalk 46 at a position opposite the front edge 18 and supplies fuel for the engine 40. A hydraulic reservoir 50 is positioned at one end of the catwalk 46 with its forward end substantially in alignment with the edge 18. An operator's cab 52 is positioned at the other end of the U-shaped catwalk 46 and extends beyond the front edge 18 so that an operator therein has a clear line of vision downward and toward the side. An offset catwalk 54 is positioned outboard and beside the cab 52 and joins with the U-shaped catwalk 46 to permit ready ingress to and egress from the cab.

An A-frame gantry, indicated generally at 56, includes a pair of angled legs 58 pinned at 60 to brackets on the winch frame 20 and a pair of vertical legs 62 pinned to the rear of the winch frame 20 at 64. The pins 64 are positioned vertically above the pins 24. Bracket 66 is secured to the upper ends of the leg 58 and pin 68 attaches the leg 62 to the bracket 66. Bail 70 having a multiple sheave pulley is pivotally attached between the brackets 66 by means of a pin 72. A bridle 74 having a multiple sheave pulley is attached to the tip of a boom 76 by pendants 78. A wire rope 80 is trained between the sheaves of the bail 70 and the bridle 74 and is wound on the boom hoist winch 36. The winch 36 controls the angle of the boom 76 which is pivotally attached at its base to the frame 16. A wire rope 82 wound on auxiliary winch 32 extends over sheaves on a boom tip extension 84 and has a hook 86 attached to its free end. A wire rope 88 wound on winch 28 is trained over a pulley or pulleys on the boom tip and supports a hook block 90.

Figure 2:
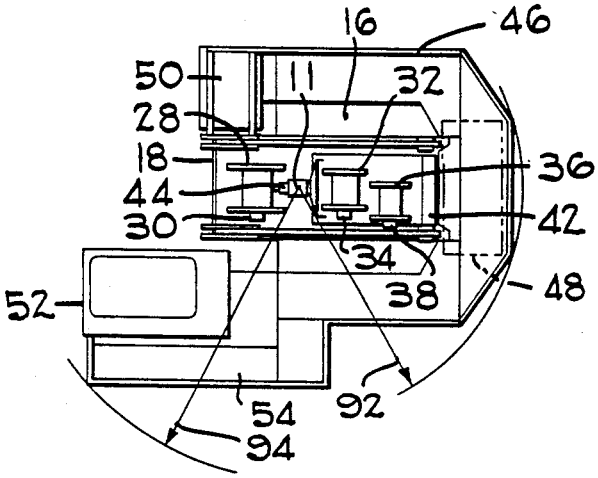
FIG. 2 is a top plan view of a portion of the crane shown in FIG. 1.
Figure 3:
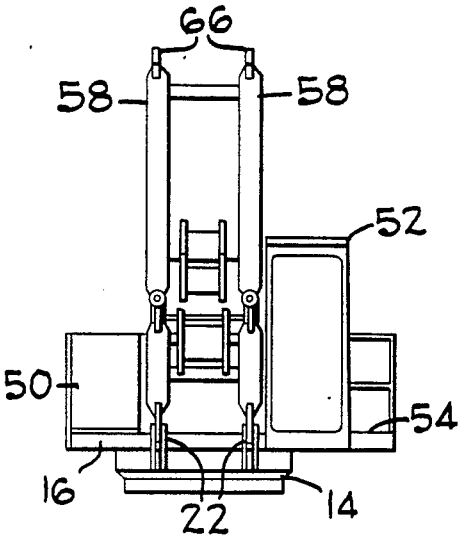
FIG. 3 is a front elevational view of the portion of the crane shown in FIG. 2.

The location of the cab, being forward of the front edge 18 of the frame 16, provides the operator with good vision, especially downward and sideward which is particularly important when working with ships from an offshore platform. The hydraulic reservoir is positioned at the end of the catwalk 46 so that it is readily accessible for maintenance and is positioned at an elevation which will provide sufficient static charge pressure to the inlet of the pump 44. The winches 28, 32 and 36 are mounted as low as possible with the catwalk extending along both sides to permit relatively easy access for maintenance and service. The engine 40 is tucked under the winch frame 20 and extends fore and aft in order to conserve space and to keep the tail swing, as indicated by the arc traced by arrow 92 in FIG. 2, to a minimum. The maximum swing clearance, as indicated by the arc traced by arrow 94, while larger than the tail swing is traced by a front portion of the crane near the boom and is less critical than tail swing, but in any event is traced by a point immediately adjacent to the operator so that visual checking of proximity to adjacent structures or articles may be easily done. Fuel tank 48 is located under the rear of the crane to facilitate filling and to keep any spillage away from the hot engine and hydraulic components.

While one embodiment of the present invention has been shown and described herein, it will be apparent that various changes and modifications may be made therein without departing from the spirit of the invention as defined by the scope of the intended claims.

What is claimed is:

1. A vertically arranged compact crane assembly for mounting on a pedestal, comprising, a main frame secured to said pedestal for rotation about a vertical axis and defining a platform of relatively limited surface area for receiving other crane components, a boom pivotally attached to said platform adjacent an edge thereof and extending outwardly therefrom, a winch frame including members extending rearwardly and upwardly from the said platform edge and on either side of the platform vertical axis in linear alignment with said boom, upstanding laterally spaced link members on said platform at the rear edge of said winch frame and connected thereto so as to define a space beneath said winch frame, winch members mounted on said frame transversely of said link members and above said space, said winches having cables for cooperative association with said boom, a gantry frame surmounted upon said winch frame and said link members including legs on either side of said winch frame so as to be free of cables extending from said winches to said boom, said gantry frame being disposed on either side of said platform vertical axis, an engine mounted on said platform in said space beneath said winch frame, and, a generally U-shaped catwalk on said platform extending along either side and around the rear edge of said engine, winch frame, winches, and gantry frame, whereby the compact vertical arrangement of said engine, winch frame, winches, and gantry frame on said platform proximate its central axis facilitates access thereto despite platform space limitations.

2. The compact crane assembly of claim 1 wherein said winches are hydraulically driven, and wherein a hydraulic pump is mounted on said platform centrally thereof and in said space, whereby access thereto is also readily had.

3. The compact crane assembly of claim 1 further including a fuel tank for said engine mounted to said platform beneath said catwalk and laterally centered with respect to said axis.

4. The compact crane assembly of claim 1 wherein said main frame forms part of a hydraulic crane offshore platform.

* * * * *